US009209540B2

(12) United States Patent
Raff et al.

(10) Patent No.: US 9,209,540 B2
(45) Date of Patent: Dec. 8, 2015

(54) BOARD-TO-BOARD CONNECTORS

(71) Applicant: Apple Inc., Cupertino, CA (US)

(72) Inventors: John Raff, Menlo Park, CA (US); Robert Scritzky, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/177,023

(22) Filed: Feb. 10, 2014

(65) Prior Publication Data

US 2014/0302692 A1 Oct. 9, 2014

Related U.S. Application Data

(60) Provisional application No. 61/762,840, filed on Feb. 8, 2013.

(51) Int. Cl.
*H01R 12/71* (2011.01)
*H01R 12/79* (2011.01)
*H01R 13/621* (2006.01)

(52) U.S. Cl.
CPC ..... *H01R 12/716* (2013.01); *H01R 12/79* (2013.01); *H01R 13/6215* (2013.01)

(58) Field of Classification Search
CPC ... H01R 13/621; H01R 13/6215; H01R 12/79
See application file for complete search history.

(56) References Cited

U.S. PATENT DOCUMENTS 3,662,321 A * 5/1972 Bury ..... 439/363
3,721,940 A * 3/1973 Michel et al. ..... 439/495
3,796,986 A * 3/1974 Tamburro ..... 439/329
4,012,093 A * 3/1977 Crane ..... 439/67
4,057,311 A * 11/1977 Evans ..... 439/66
4,416,496 A * 11/1983 Brefka ..... 439/59
4,538,865 A * 9/1985 Wakabayashi et al. ..... 439/66
4,587,377 A * 5/1986 Rodseth ..... 174/16.3
4,636,018 A * 1/1987 Stillie ..... 439/66
4,647,125 A * 3/1987 Landi et al. ..... 439/67
4,693,529 A * 9/1987 Stillie ..... 439/67
4,695,258 A * 9/1987 Hanson et al. ..... 439/67
4,913,656 A * 4/1990 Gordon et al. ..... 439/67
4,929,185 A * 5/1990 Wong et al. ..... 439/74
4,948,374 A * 8/1990 Carter ..... 439/67
4,998,887 A * 3/1991 Kaufman et al. ..... 439/78
5,051,366 A * 9/1991 Anderson et al. ..... 436/67
5,152,694 A 10/1992 Bargain
5,160,269 A * 11/1992 Fox et al. ..... 439/67
5,219,293 A * 6/1993 Imamura ..... 439/67
5,221,209 A 6/1993 D'Amico
5,252,079 A 10/1993 Grabbe
5,259,781 A * 11/1993 Baumberger et al. ..... 439/362

(Continued)

*Primary Examiner* — Ross Gushi
(74) *Attorney, Agent, or Firm* — Kilpatrick Townsend & Stockton LLP

(57) ABSTRACT

Board-to-board connectors that may provide a durable and reliable connection, save board space, may be easy to manufacture, and may be simple to use during device assembly. One example may include a receptacle including a number of contacts forming electrical connections with traces or planes in or on a printed circuit board. A boss may be included as part of the receptacle and the boss may be connected to the printed circuit board. An insert may be mated to the receptacle. Contacts in the insert may form electrical connections with traces or planes in a second or flexible circuit board. A cowling may be placed over the flexible circuit board to act as a stiffener. A fastener, such as a screw, may be placed through openings in the cowling, second or flexible circuit board, and insert, and into the boss.

23 Claims, 15 Drawing Sheets

(56) References Cited

U.S. PATENT DOCUMENTS

| | | | | |
|---|---|---|---|---|
| 5,295,838 | A * | 3/1994 | Walen et al. | 439/67 |
| 5,384,433 | A | 1/1995 | Osann, Jr. et al. | |
| 5,525,064 | A * | 6/1996 | Mowry | 439/66 |
| 5,575,686 | A * | 11/1996 | Noschese | 439/620.21 |
| 5,685,073 | A * | 11/1997 | Estes et al. | 29/883 |
| 5,730,619 | A * | 3/1998 | Hamlin | 439/493 |
| 5,871,362 | A * | 2/1999 | Campbell et al. | 439/67 |
| 6,017,244 | A * | 1/2000 | Daane | 439/495 |
| 6,039,581 | A * | 3/2000 | DiMarco | 439/74 |
| 6,077,090 | A * | 6/2000 | Campbell et al. | 439/67 |
| 6,257,918 | B1 * | 7/2001 | Yamamoto | 439/364 |
| 6,309,223 | B1 * | 10/2001 | Wolfe | 439/67 |
| 6,368,117 | B1 * | 4/2002 | Taylor | 439/67 |
| 6,409,526 | B1 * | 6/2002 | Malone et al. | 439/160 |
| 6,425,768 | B1 * | 7/2002 | Taylor | 439/67 |
| 6,431,879 | B2 * | 8/2002 | Brekosky et al. | 439/74 |
| 6,520,789 | B2 * | 2/2003 | Daugherty et al. | 439/329 |
| 6,579,104 | B1 * | 6/2003 | Bishop et al. | 439/66 |
| 6,614,659 | B2 * | 9/2003 | Feigenbaum et al. | 361/719 |
| 6,634,890 | B2 * | 10/2003 | Peterson et al. | 439/67 |
| 6,822,466 | B1 * | 11/2004 | Holcombe et al. | 324/750.25 |
| 6,843,629 | B2 * | 1/2005 | Farral et al. | 411/178 |
| 6,863,543 | B2 * | 3/2005 | Lang et al. | 439/75 |
| 6,869,291 | B2 * | 3/2005 | Norland et al. | 439/67 |
| 6,926,537 | B1 * | 8/2005 | Auchincloss et al. | 439/67 |
| 7,046,020 | B2 * | 5/2006 | LaMeres et al. | 324/754.07 |
| 7,223,106 | B2 * | 5/2007 | Nakajima et al. | 439/74 |
| 7,323,892 | B1 * | 1/2008 | LaMeres et al. | 324/750.25 |
| 7,347,719 | B2 * | 3/2008 | Geibel et al. | 439/449 |
| 7,407,408 | B1 * | 8/2008 | Taylor | 439/449 |
| 7,438,582 | B2 * | 10/2008 | Taylor | 439/342 |
| 7,465,195 | B1 * | 12/2008 | Kerrigan et al. | 439/607.05 |
| 7,740,489 | B2 * | 6/2010 | Trout et al. | 439/75 |
| 8,251,712 | B2 * | 8/2012 | Cheng | 439/67 |
| 8,758,067 | B2 | 6/2014 | Rathburn | |
| 2002/0142629 | A1 * | 10/2002 | Zaderej et al. | 439/74 |
| 2003/0113183 | A1 * | 6/2003 | McAfee | 411/107 |
| 2004/0258500 | A1 * | 12/2004 | Ireland | 411/81 |
| 2006/0216960 | A1 * | 9/2006 | Chang | 439/74 |
| 2006/0264096 | A1 * | 11/2006 | Johnson | 439/566 |
| 2010/0093193 | A1 * | 4/2010 | Trout et al. | 439/74 |
| 2014/0113475 | A1 * | 4/2014 | Malek et al. | 439/306 |
| 2014/0120788 | A1 * | 5/2014 | Kodaira et al. | 439/892 |
| 2014/0148021 | A1 * | 5/2014 | Hsu | 439/67 |
| 2014/0302692 | A1 * | 10/2014 | Raff et al. | 439/65 |

* cited by examiner

BOARD-TO-BOARD CONNECTORS

This application is a nonprovisional of U.S. provisional application No. 61/762,840, filed Feb. 8, 2013, which is incorporated by reference.

BACKGROUND

The number of types of electronic devices that are commercially available has increased tremendously the past few years, and the rate of introduction of new devices shows no signs of abating. Devices, such as tablet, laptop, netbook, desktop, and all-in-one computers, cell, smart, and media phones, storage devices, portable media players, navigation systems, monitors, and others, have become ubiquitous.

The functionality of these devices has likewise greatly increased. This in turn has led to increased complexity inside of these electronic devices. For example, various types of boards, such as flexible circuit boards, printed circuit boards, and others, are often included in a single device. These boards may be connected together using board-to-board connectors.

These connectors should typically be reliable, otherwise disconnections between circuits and components could occur leading to a loss of functionality or failure of the device. They should also be durable. This way, if the device is dropped or otherwise jarred, a disconnection may be avoided.

Often these connectors may be large. This, in turn, may consume board area and space inside an electronic device. This may result in either the device having less functionality, a larger size, or a combination of the two. Smaller connectors may save space, allowing more functionality in a device, they may allow a device to be smaller, or a combination of each.

Board-to-board connectors may also be somewhat complicated to manufacture. This may lead to increased device costs. Connectors that may be easier to manufacture may reduce costs.

Further, these connectors may be difficult to use in a manufacturing environment. That is, it may be difficult for assembly operators or machines to connect one board to another using conventional connectors. Connectors that are easier to assemble may reduce operator fatigue and error.

Thus, what is needed are board-to-board connectors that may provide a durable and reliable connection, save board space, may be easy to manufacture, and may be simple to use during device assembly.

SUMMARY

Accordingly, embodiments of the present invention may provide board-to-board connectors that may provide a durable and reliable connection, save board space, may be easy to manufacture, and may be simple to assemble.

An illustrative embodiment of the present invention may provide board-to-board connectors that provide a durable and reliable connection by securing a fastener through an insert and into a boss that is integrated in a receptacle. In this example, the boss may be press-fit into the receptacle, the receptacle may be injection-molded or otherwise formed around the boss, or the boss may be otherwise attached or integrated with the receptacle. The insert may be mated to the receptacle. The fastener may be inserted through an opening in the insert and into the boss in order to secure the insert to the receptacle. The fastener may be a screw, bolt, or other type of fastener. An adhesive may be used to further secure the fastener.

Embodiments of the present invention are particularly well-suited to connecting flexible circuit boards to printed circuit boards. In such a situation, a cowling may be used to act as a stiffener for the flexible circuit board. The cowling may have an opening to accept the fastener. Embodiments of the present invention may be used to connect two or more boards together, where the two or more boards include flexible circuit boards, printed circuit boards, or other appropriate boards. For example, embodiments of the present invention may be used to connect two flexible circuit boards, two printed circuit boards, two flexible circuit boards and one printed circuit board, or other combination.

An illustrative embodiment of the present invention may provide board-to-board connectors where contacts in a receptacle form electrical connections with traces or planes in or on a first or printed circuit board. Similarly, contacts in an insert may form electrical connections with traces or planes in or on a second or flexible circuit board. Contacts in the insert may mate with contacts in the receptacle. In this way, traces and planes on a first or printed circuit board may be electrically connected to trances and planes on a second or flexible circuit board.

An illustrative embodiment of the present invention may provide board-to-board connectors that save space by integrating a boss with a receptacle. By not requiring separate fastener components, less board area is consumed.

An illustrative embodiment of the present invention may provide board-to-board connectors that are easy to manufacture. A receptacle may be mounted on a first or printed circuit board. The receptacle may include a number of contacts having contacting portions that may form electrical connections with traces or planes in or on the printed circuit board. The contacting portions of the contacts may be surface-mount, through-hole, or other type of contacting portions. One or more bosses may be included as part of the receptacle. Specifically, the bosses may be press-fit into the receptacle, the receptacle may be injection-molded or otherwise formed around the boss, or the bosses may be otherwise attached or integrated with the receptacle. The bosses may have a contacting portion that may be electrically connected to a ground or other connection on or in the printed circuit board. The contacting portions of the bosses may be surface-mount, through-hole, or other type of contacting portions. The bottom side of the boss (or bosses) may be closed or have an opening, they may have a flat surface, they may have outwardly flared or flange portions, or they may have other shapes or configurations. An insert may be mated to the receptacle such that contacts in the insert form electrical connections with contacts in the receptacle. Contacts in the insert may have surface-mount, through-hole, or other type of contacting portions that are in electrical connections with traces or planes in a second or flexible circuit board. A cowling may be placed over the flexible circuit board to act as a stiffener. A fastener, such as a screw, may be placed through openings in the cowling, second or flexible circuit board, and insert, and into the boss.

An illustrative embodiment of the present invention may provide board-to-board connectors that are durable. This may be of particular value in mobile devices, where the need for reduced size and durability is acute. For example, it may be useful to increase the retention force in a board-to-board connector in a mobile device, since such devices may be likely to experience shocks and vibration that may otherwise disconnect a connector. Conventionally, this retention force may be increased by shaping an insert to have a more positive or distinct snap when inserted into a receptacle. But this may decrease lengths of contacts in the insert and receptacle, thereby reducing the contact's length of engagement or wipe.

By providing a fastener to secure an insert to a receptacle, the wipe on embodiments of the present invention may be increased and improved.

An illustrative embodiment of the present invention may provide board-to-board connectors that are simple to use in a manufacturing environment. In one embodiment, an insert on a flexible circuit board may be aligned with a receptacle on a printed circuit board. A cowling may be placed over or attached to the flexible circuit board. A fastener, such as a screw, may be inserted through a hole in the cowling and into a boss in the receptacle. The screw or other fastener may be tightened or otherwise secured.

In various embodiments of the present invention, a boss may be formed by stamping, metal-injection molding, machining, micro-machining, 3-D printing, or other manufacturing process. The insert and receptacle contacts and boss may be formed of stainless steel, steel, copper, copper titanium, phosphor bronze, or other material or combination of materials. They may be plated or coated with nickel, gold, or other material. The insert and receptacle housings may be formed of silicon or silicone, rubber, hard rubber, plastic, nylon, liquid-crystal polymers (LCPs), or other nonconductive material or combination of materials.

Various embodiments of the present invention may employ one, two, three, or more than three bosses and corresponding fasteners. The use of these fasteners may result in board-to-board connectors that are simple to use in a manufacturing environment. They may reduce operator fatigue and error. They may simplify any necessary rework procedures as well.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
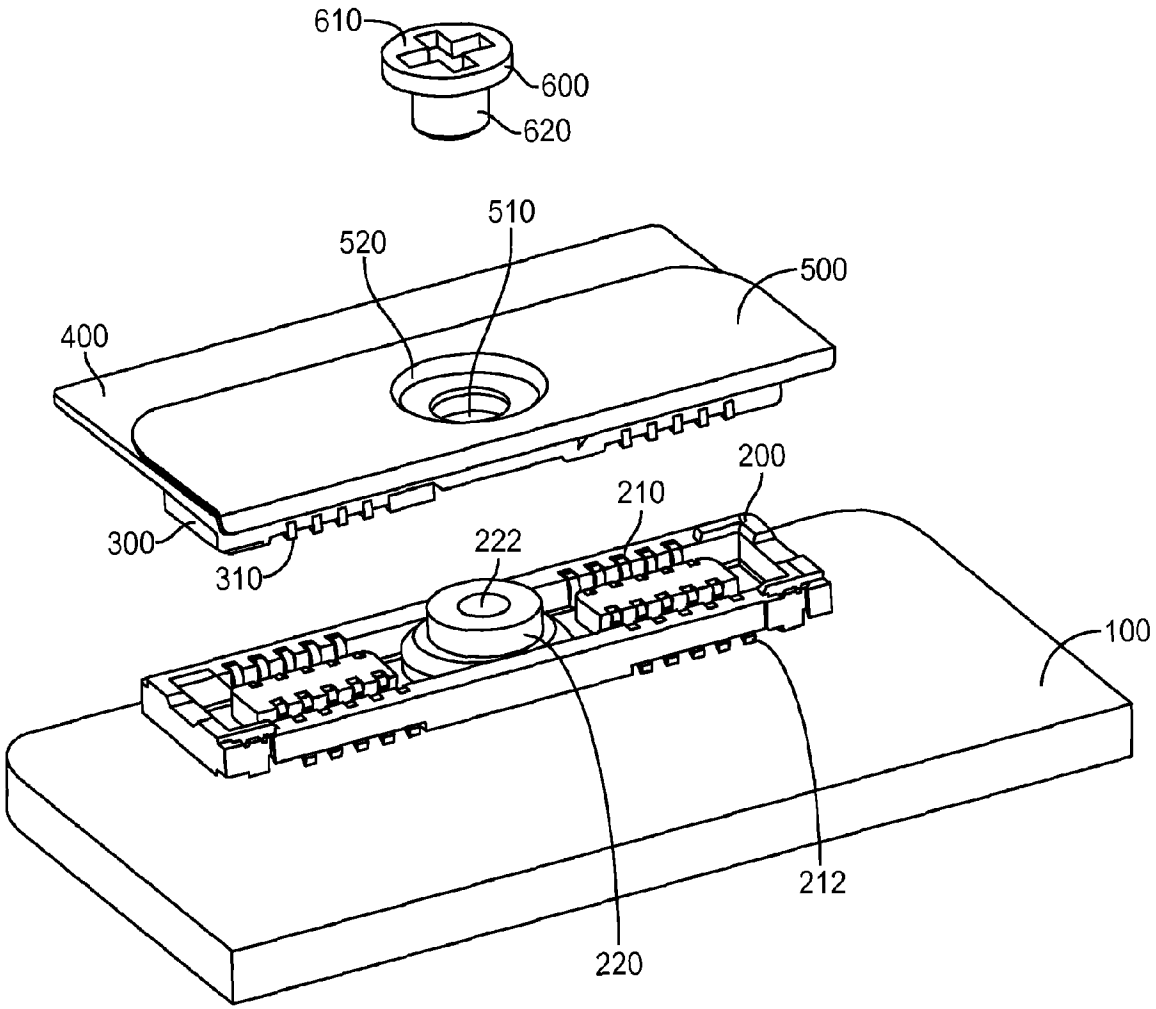
FIG. 1 illustrates a perspective view of a portion of an electronic system according to an embodiment of the present invention.

FIG. 1 illustrates a perspective view of a portion of an electronic system according to an embodiment of the present invention. In this figure, printed circuit board 100 may be connected to flexible circuit board 400 by a board-to-board connector according to an embodiment of the present invention. This figure, as with the other included figures, is shown for illustrative purposes and does not limit either the possible embodiments of the present invention or the claims.

Receptacle or socket 200 may be mounted on printed circuit board 100. Receptacle 200 may include a number of contacts 210, each including contacts portion 212. Contact portions 212 may be through-hole, surface-mount, or other contact portions. For example, contact portions 212 may be surface mount contact portions that are at least approximately at the same level as a bottom surface of receptacle 200. Contact portions 212 may form electrical connections with traces or planes on or in printed circuit board 100. Boss or nut 220 may be integrated with receptacle 200. Specifically, boss 220 may be press-fit into receptacle 200, receptacle 200 may be injection molded around boss 220, boss 220 and receptacle 200 may be 3-D printed as a unit or separately, or boss 220 may be otherwise attached to receptacle 200. Boss 220 may include opening 222. Boss 220 may include a surface-mount, through-hole, or other type of connection portion. For example, a bottom of boss 220 may include a flat surface with or without an opening at approximately a bottom surface of receptacle 200, where the flat surface of boss 220 is surface mounted to a ground pad or plane portion on printed circuit board 100. In this way boss 220, as with the other included bosses, may be connected to ground.

Insert 300 may be mounted on flexible circuit board 400. Insert 300 may include contacts 310 to form electrical connections with contacts 210 in receptacle 200. Cowling 500 may be placed over flexible circuit board 400 to act as a stiffener. Cowling 500, flexible circuit board 400, and insert 300 may include opening 510. Fastener 600 may include a portion 620 inserted through hole 510 into opening 222 of boss 220. Portion 620 of fastener 600 may be threaded to mate with a threaded opening 222 of boss 220, portion 620 may be arranged to snap into opening 222 of boss 220, or portion 620 may mate with opening 222 in boss 220 in other ways. Cowling 500 may include recessed area 520 around opening 510. Fastener head 610 may reside in recessed portion 520 of cowling 500. Fastener 600 may be a screw, bolt, or other type of fastener. An adhesive may be applied to fastener 600 or boss 220 (or both) to secure or to further secure fastener 600 to boss 220. Fastener 610 may be easily inserted and removed thereby providing a connector that is easy to use in a manufacturing environment. This may reduce operator fatigue and error and simplify any rework that may need to be done.

In this and the other examples, traces on or in a printed circuit board may electrically connect to traces in a flexible circuit board. For example, traces on or in printed circuit board 100 may electrically connect to contact portions 212, which may be connected to contacts 210 in receptacle 200.

Contacts 210 may mate with contacts 310 in insert 300. Contacts 310 may electrically connect to traces in flexible circuit board 400.

Figure 2:
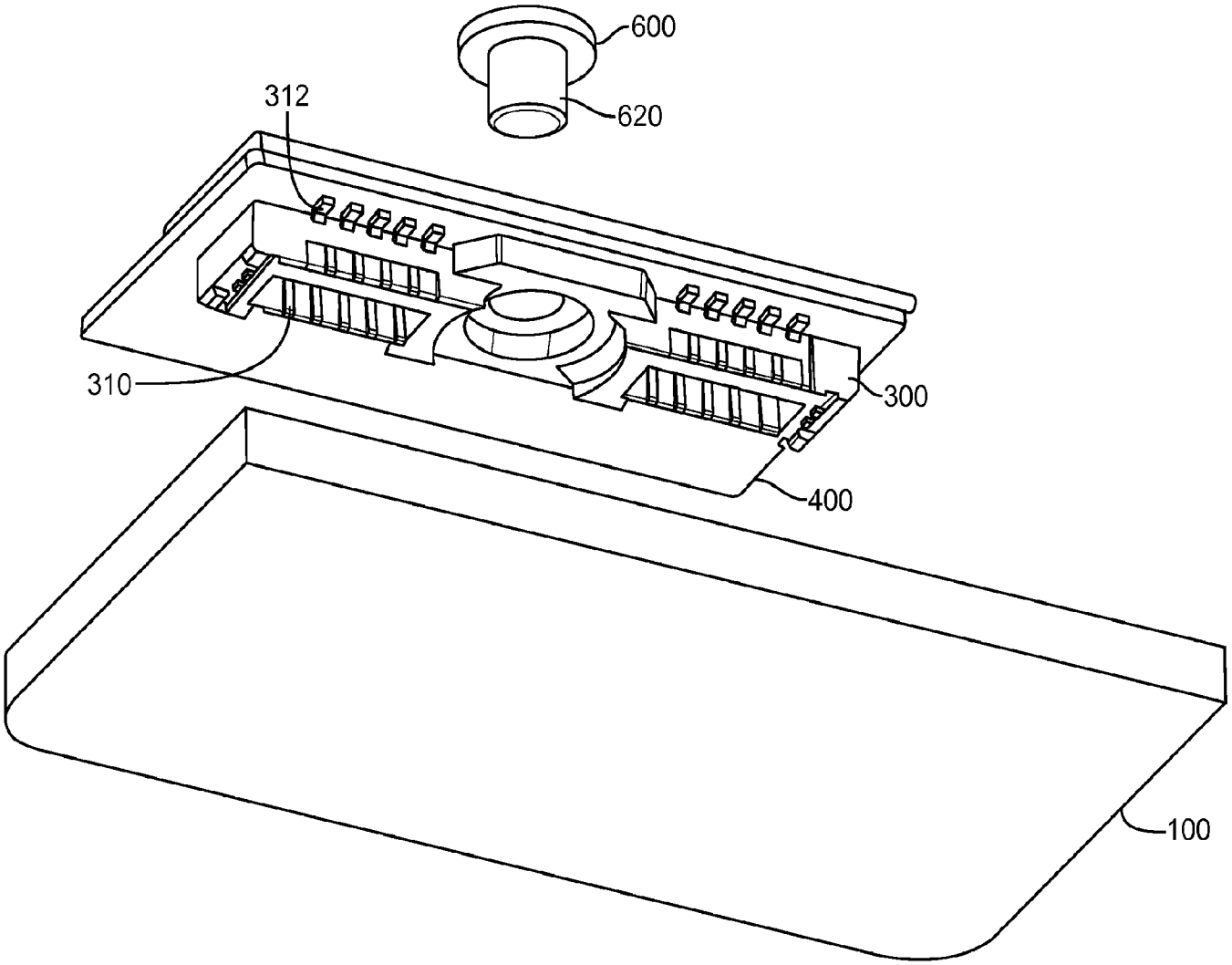
FIG. 2 illustrates another perspective view of a portion of an electronic system according to an embodiment of the present invention.

FIG. 2 illustrates another perspective view of a portion of an electronic system according to an embodiment of the present invention. Insert 300 may include contacts 310 having contact portions 312. Contact portions 312 may be surface-mount, through-hole, or other type of contact portions. Contact portions 312 may form electrical connections with traces or planes in flexible circuit board 400.

In this example, traces and planes in or on printed circuit board 100 may be electrically connected to traces and planes in flexible circuit board 400. In other embodiments of the present invention, traces in three or more boards may be connected. Also, while in these examples, flexible circuit boards are connected to printed circuit boards, in other embodiments the present invention, two or more flexible circuit boards, or two or more printed circuit boards may be connected together.

In various embodiments of the present invention, printed circuit board 100 may be a main logic board, a motherboard, or other type of printed circuit board. Printed circuit board 100 and flexible circuit board 400 may be located in various electronic devices, such as portable computing devices, tablets, desktop computers, laptops, all-in-one computers, cell phones, smart phones, media phones, storage devices, portable media players, navigation systems, monitors and other devices.

Figure 3:
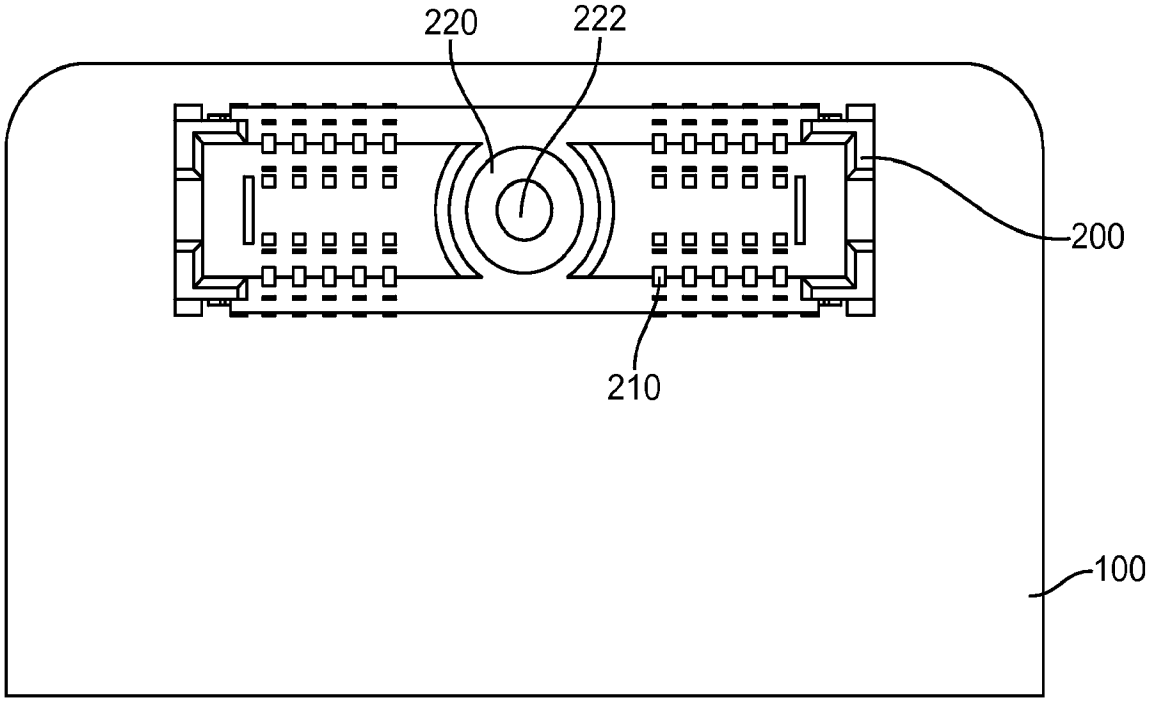
FIG. 3 illustrates a top view of a receptacle mounted on printed circuit board.

FIG. 3 illustrates a top view of receptacle 200 mounted on printed circuit board 100. Receptacle 200 may include contacts 210 and boss 220. Boss 220 may include opening 222 for accepting an end of a fastener.

Figure 4:
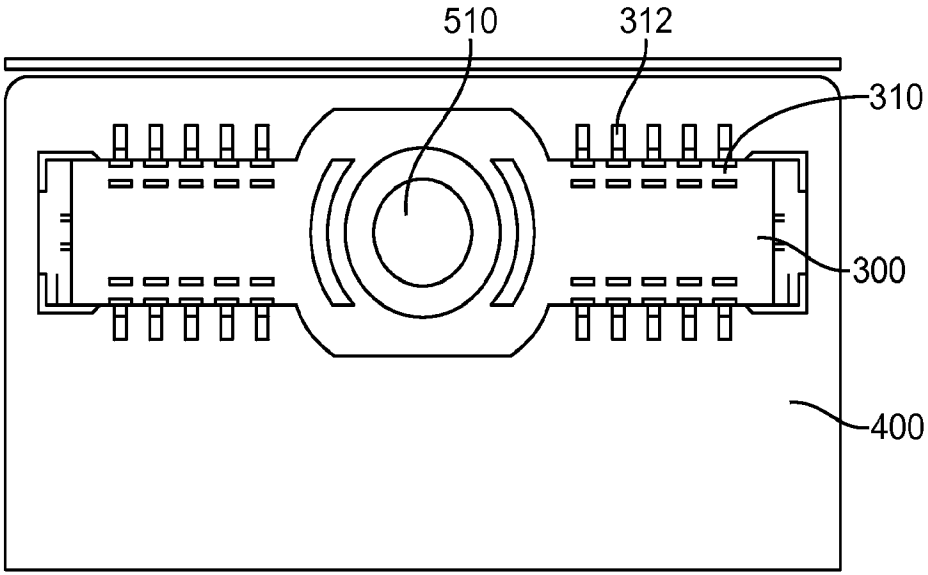
FIG. 4 illustrates a top view of an insert mounted on a flexible circuit board.

FIG. 4 illustrates a top view of insert 300 mounted on flexible circuit board 400. Insert 300 may include contacts 310 having contact portions 312. Flexible circuit board 400 and insert 300 may include opening 510 for accepting an end of a fastener.

Figure 5:
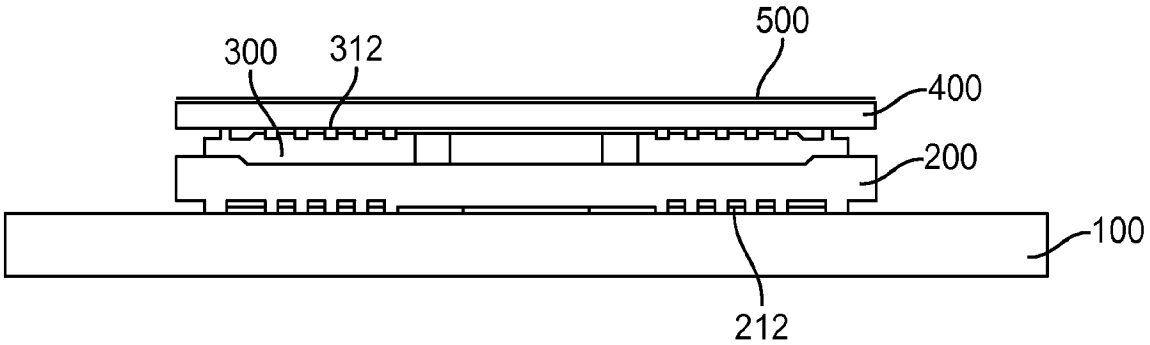
FIG. 5 illustrates a side view of a portion of an electronic system according to an embodiment of the present invention.

FIG. 5 illustrates a side view of a portion of an electronic system according to an embodiment of the present invention. Receptacle 200 may be mounted on printed circuit board 100. Receptacle 200 may include contacts having contact portions 212. Contact portions 212 may connect to traces or planes on or in printed circuit board 100. Insert 300 may be mated with receptacle 200. Insert 300 may include contacts 310 having contact portions 312. Contact portions 312 may form electrical connections with traces or planes on our and flexible circuit board 400. Cowling 500 may be placed over flexible circuit board 400 to act as a stiffener.

In the above example, one fastener may be inserted into one corresponding boss to secure a flexible circuit board to a printed circuit board. In other embodiments the present invention, two or more such fasteners and corresponding bosses may be used. These bosses may be located at various portions of a receptacle. For example, these bosses may be placed at ends of a receptacle. Examples are shown in the following figures.

Figure 6:
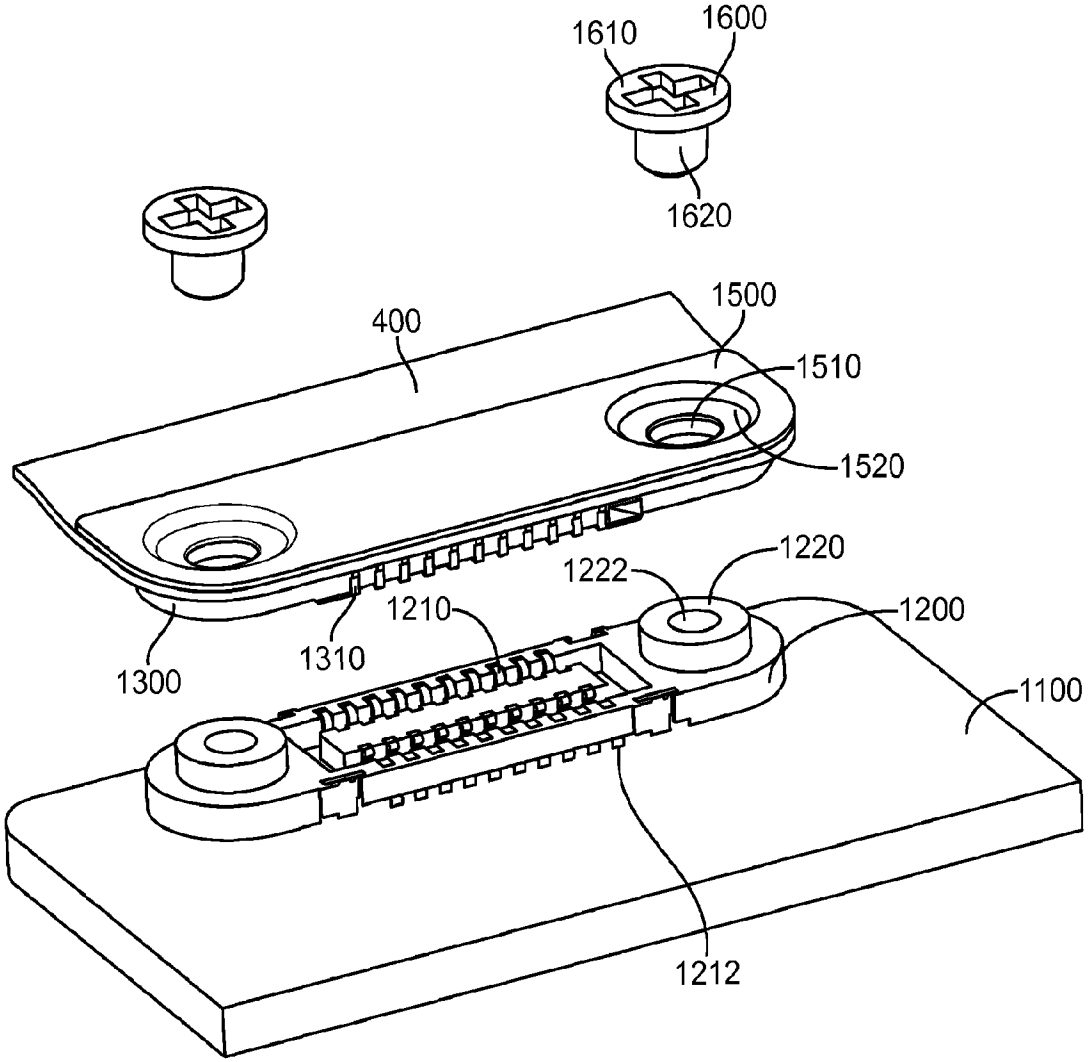
FIG. 6 illustrates a perspective view of a portion of another electronic system according to an embodiment of the present invention.

FIG. 6 illustrates a perspective view of a portion of another electronic system according to an embodiment of the present invention. In this figure, printed circuit board 1100 may be connected to flexible circuit board 1400 by a board-to-board connector according to an embodiment of the present invention.

Receptacle or socket 1200 may be mounted on printed circuit board 1100. Receptacle 1200 may include a number of contacts 1210, each including contacts portion 1212. Contact portions 1212 may be through-hole, surface-mount, or other contacts portions. Contact portions 1212 may form electrical connections with traces or planes on or in printed circuit board 1100. Bosses or nuts 1220 may be integrated with receptacle 1200. Specifically, bosses 1220 may be press-fit into receptacle 1200, receptacle 1200 may be injection molded around bosses 1220, bosses 1220 and receptacle 1200 may be 3-D printed as a unit or separately, or bosses 1220 may be otherwise attached to receptacle 1200. Bosses 1220 may include openings 1222. Bosses 1220 may include a surface-mount, through-hole, or other type of connection portion. For example, a bottom of bosses 1220 may each include a flat surface that may be closed or have an opening, and may be surface mounted to ground pads or plane portions on printed circuit board 1100. In this way, bosses 1220 may be grounded.

Insert 1300 may be mounted on flexible circuit board 1400. Insert 1300 may include contacts 1310 to form electrical connections with contacts 1210 in receptacle 1200. Cowling 1500 may be placed over flexible circuit board 1400 to act as a stiffener. Cowling 1500, flexible circuit board 1400, and insert 1300 may include openings 1510. Fasteners 1600 may each include a portion 1620 inserted through holes 1510 into openings 1222 of bosses 1220. Portions 1620 of fasteners 1600 may be threaded to mate with threaded openings 1222 of bosses 1220, portions 1620 may be arranged to snap into openings 1222 of bosses 1220, or portions 1620 may mate with openings 1222 in bosses 1220 in other ways. Cowling 1500 may include recessed areas 1520 around openings 1510. Fastener heads 1610 may reside in recessed portions 1520 of cowling 1500. Fasteners 1600 may be screws, bolts, or other type of fasteners. Fastener heads 1600 may reside in recessed portion 1520 of cowling 1500. An adhesive may be applied to fasteners 1600 or bosses 1220 (or both) to secure or to further secure fasteners 1610 to bosses 1220. Fasteners 1600 may be easily inserted and removed thereby providing a connector that is easy to use in a manufacturing environment. Again, this may reduce operator fatigue and error and simplify any rework that may need to be done.

In this and the other examples, traces on or in a printed circuit board may electrically connect to traces in a flexible circuit board. For example, traces on or in printed circuit board 1100 may electrically connect to contact portions 1212, which may be connected to contacts 1210 in receptacle 1200. Contacts 1210 may mate with contacts 1310 in insert 1300. Contacts 1310 may electrically connect to traces in flexible circuit board 1400.

Figure 7:
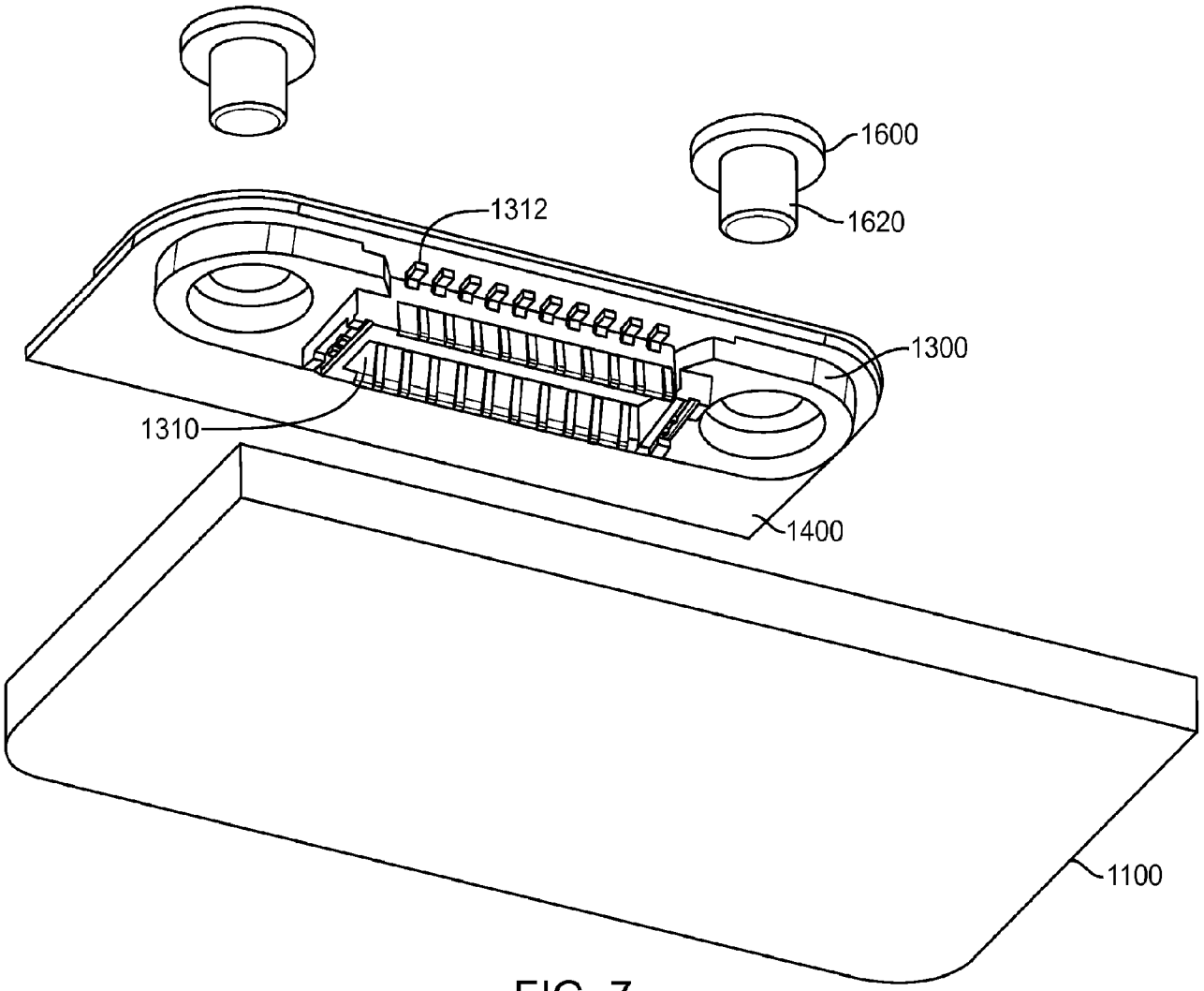
FIG. 7 illustrates another perspective view of a portion of an electronic system according to an embodiment of the present invention.

FIG. 7 illustrates another perspective view of a portion of an electronic system according to an embodiment of the present invention. Insert 1300 may include contacts 1310 having contact portions 1312. Contact portions 1312 may be surface-mount, through-hole, or other type of contact portions. Contact portions 1312 may form electrical connections with traces or planes in flexible circuit board 1400.

In various embodiments of the present invention, printed circuit board 1100 may be a main logic board, a motherboard, or other type of printed circuit board. Printed circuit board 1100 and flexible circuit board 1400 may be located in various electronic devices, such as portable computing devices, tablets, desktop computers, laptops, all-in-one computers, cell phones, smart phones, media phones, storage devices, portable media players, navigation systems, monitors and other devices.

Figure 8:
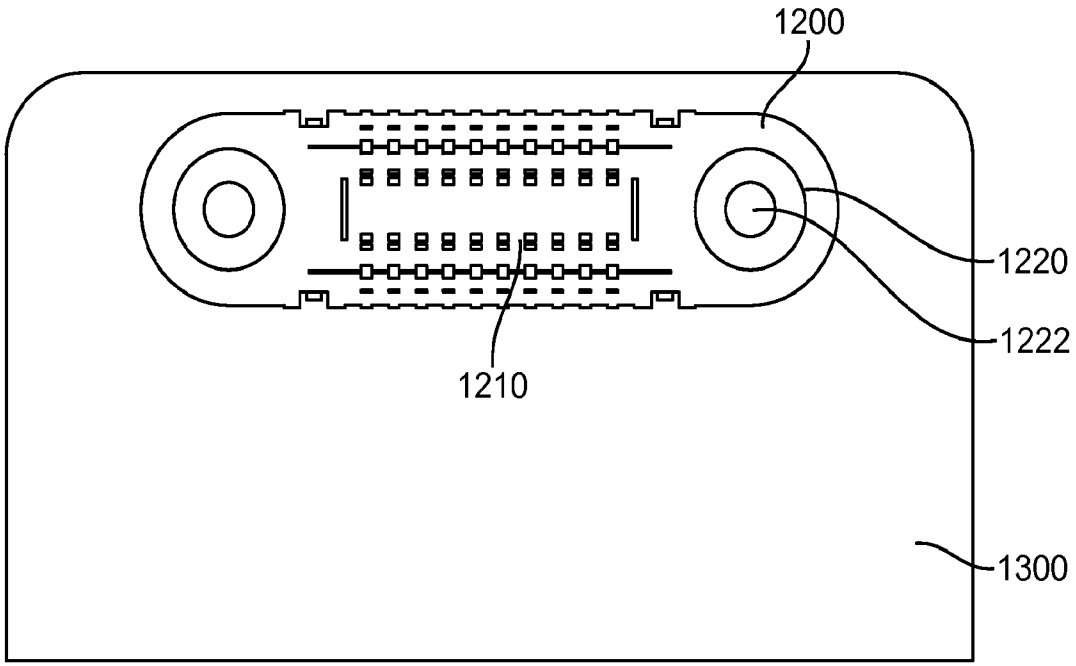
FIG. 8 illustrates a top view of a receptacle mounted on printed circuit board.

FIG. 8 illustrates a top view of receptacle 1200 mounted on printed circuit board 1100. Receptacle 1200 may include contacts 1210 and bosses 1220. Bosses 1220 may each include opening 1222 for accepting an end of a fastener.

Figure 9:
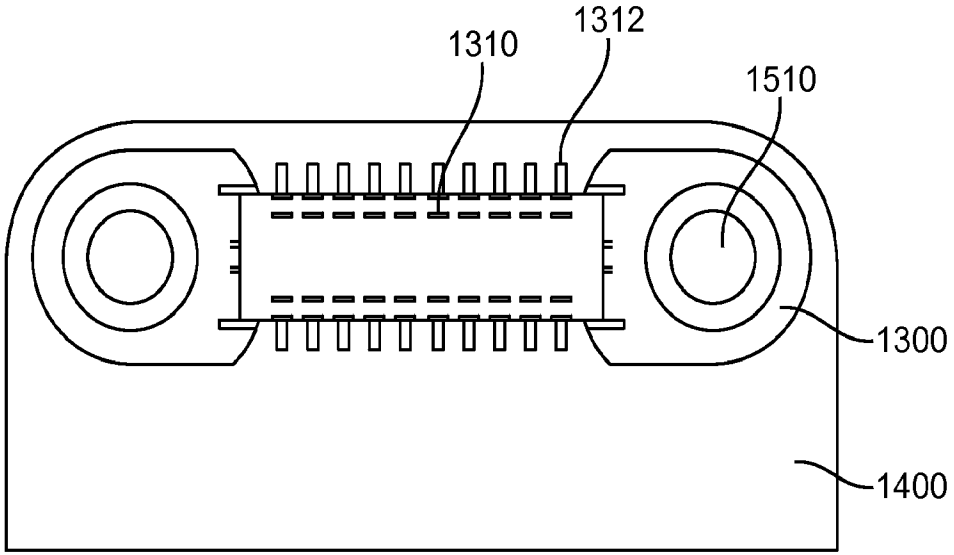
FIG. 9 illustrates a top view of an insert mounted on a flexible circuit board.

FIG. 9 illustrates a top view of insert 1300 mounted on flexible circuit board 1400. Insert 1300 may include contacts 1310 having contact portions 1312. Flexible circuit board 1400 and insert 1300 may include openings 1510 for accepting ends of fasteners.

Figure 10:
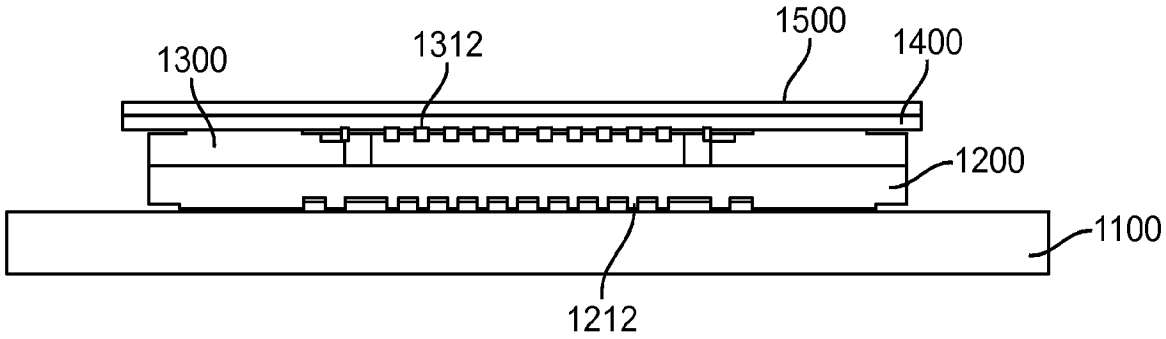
FIG. 10 illustrates a side view of a portion of an electronic system according to an embodiment of the present invention.

FIG. 10 illustrates a side view of a portion of an electronic system according to an embodiment of the present invention. Receptacle 1200 may be mounted on printed circuit board 1100. Receptacle 1200 may include contacts having contact portions 1212. Contact portions 1212 may connect to traces or planes on or in printed circuit board 1100. Insert 1300 may be mated with receptacle 1200. Insert 1300 may include contacts 1310 having contact portions 1312. Contact portions 1312 may form electrical connections with traces or planes on our and flexible circuit board 1400. Cowling 1500 may be placed over flexible circuit board 1400 to act as a stiffener.

Figure 11:
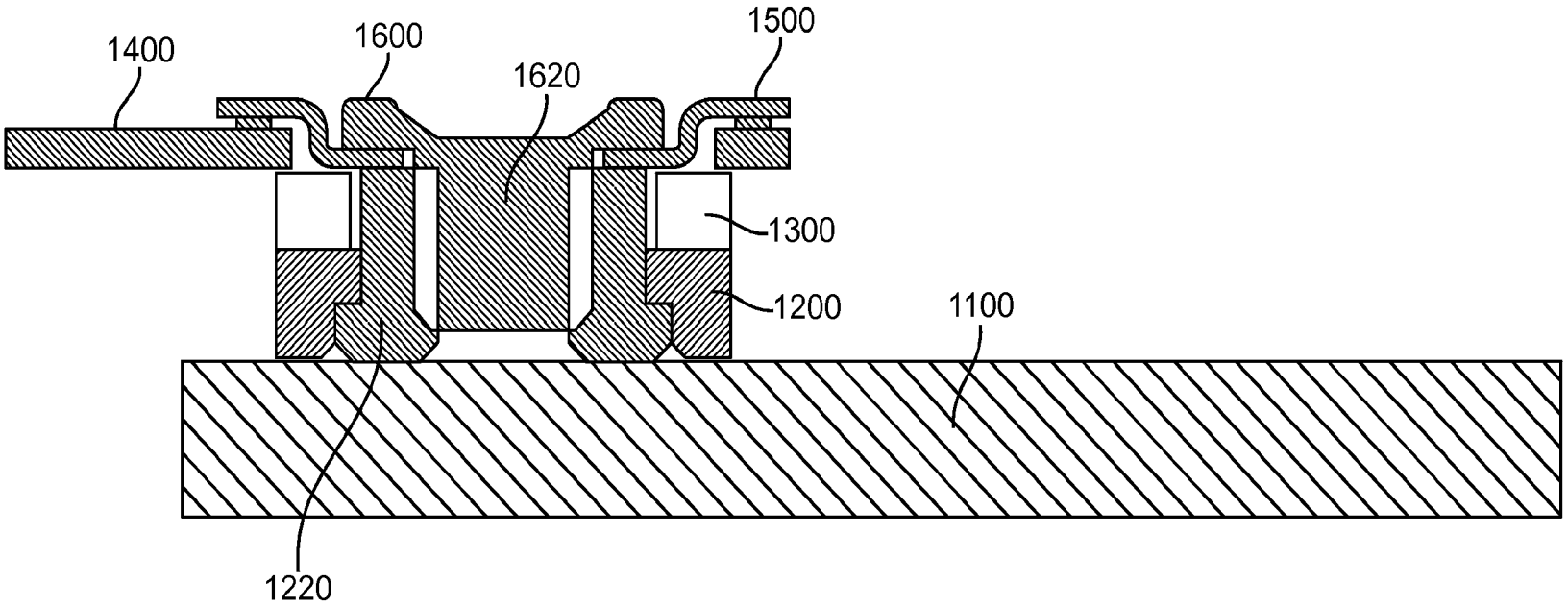
FIG. 11 illustrates a cut away side view of a portion of an electronic system according to an embodiment of the present invention.

FIG. 11 illustrates a cut away side view of a portion of an electronic system according to an embodiment of the present invention. Receptacle 1200 may be mounted on printed circuit board 1100. Insert 1300 may be mated with receptacle 1200. Insert 1300 may be attached to flexible circuit board 1400. Cowling 1500 may be placed over flexible circuit board 1400 to act as a stiffener. Portion 1620 of fastener 1600 may be inserted into boss 1220. Portion 1620 and an inside of boss 1220 may each be threaded. A bottom of boss 1220 may have an opening as shown, or it may be closed.

Figure 12:
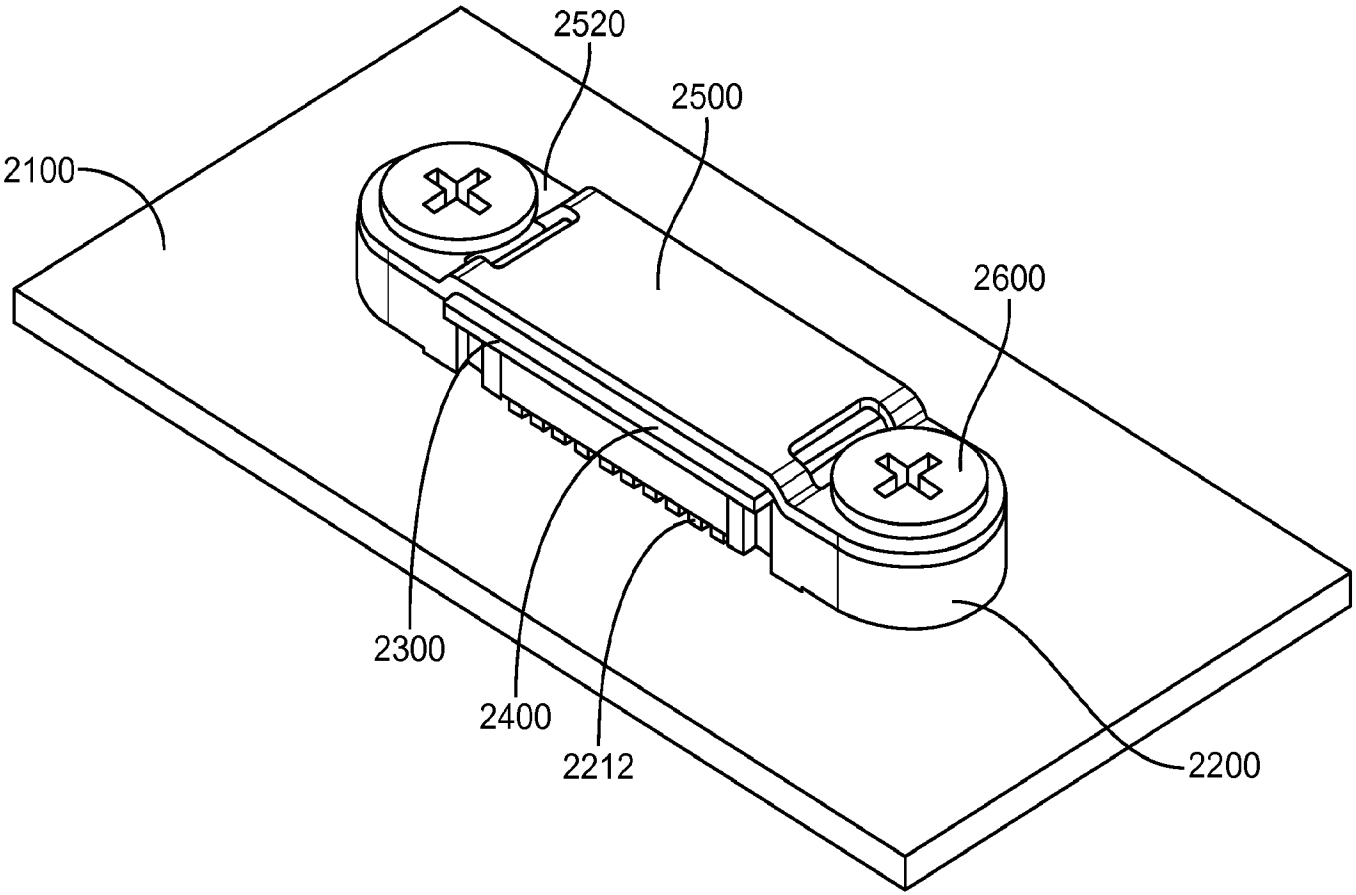
FIG. 12 illustrates a perspective view of a portion of another electronic system according to an embodiment of the present invention.

FIG. 12 illustrates a perspective view of a portion of another electronic system according to an embodiment of the present invention. In this figure, printed circuit board 2100 may be connected to flexible circuit board 2400 by a board-to-board connector according to an embodiment of the present invention.

Receptacle or socket 2200 may be mounted on printed circuit board 2100. Receptacle 2200 may include a number of contacts (not shown), each including contacts portion 2212. Contact portions 2212 may be through-hole, surface-mount, or other contacts portions. Contact portions 2212 may form electrical connections with traces or planes on or in printed circuit board 2100. Bosses or nuts (not shown) may be integrated with receptacle 2200. Specifically, bosses may be press-fit into receptacle 2200, receptacle 2200 may be injection molded around the bosses, the bosses and receptacle 2200 may be 3-D printed as a unit or separately, or the bosses may be otherwise attached to receptacle 2200. The bosses may include openings (not shown). The bosses may include a surface-mount, through-hole, or other type of connection portion. For example, the bosses may each include a flat bottom surface that may be surface mounted to ground pads or plane portions on printed circuit board 2100. The bosses may instead include outwardly flared or flange portions arranged to mate with a solderable area on printed circuit board 2100. In this way, the bosses may be grounded.

Insert 2300 may be mounted on flexible circuit board 2400. (In this example, insert 2300 is mounted on an underside of flexible circuit board 2400 and is not actually visible.) Insert 2300 may include contacts (not shown) to form electrical connections with contacts in receptacle 2200. Cowling 2500 may be placed over flexible circuit board 2400 to act as a stiffener. Cowling 2500, flexible circuit board 2400, and insert 2300 may include openings. Fasteners 2600 may each include a portion inserted through holes in cowling 2500 into openings of the bosses. Portions of fasteners 2600 may be threaded to mate with threaded openings of bosses 2220, portions may be arranged to snap into openings of the bosses, or portions may mate with openings in the bosses in other ways. Cowling 2500 may include recessed areas 2520 around the openings. The heads of fasteners 2600 may reside in recessed portions 2520 of cowling 2500. Fasteners 2600 may be screws, bolts, or other type of fasteners. Fastener heads 2610 may reside in recessed portion 520 of cowling 500. An adhesive may be applied to fasteners 2610 or bosses 2220 (or both) to secure or to further secure fasteners 2610 to bosses 2220. Fasteners 2600 may be easily inserted and removed thereby providing a connector that is easy to use in a manufacturing environment. Again, this may reduce operator fatigue and error and simplify any rework that may need to be done.

In this and the other examples, traces on or in a printed circuit board may electrically connect to traces in a flexible circuit board. For example, traces on or in printed circuit board 2100 may electrically connect to contact portions 2212, which may be connected to contacts in receptacle 2200. Contacts in receptacle 2200 may mate with contacts in insert 2300. Contacts in insert 2300 may electrically connect to traces in flexible circuit board 2400.

Figure 13:
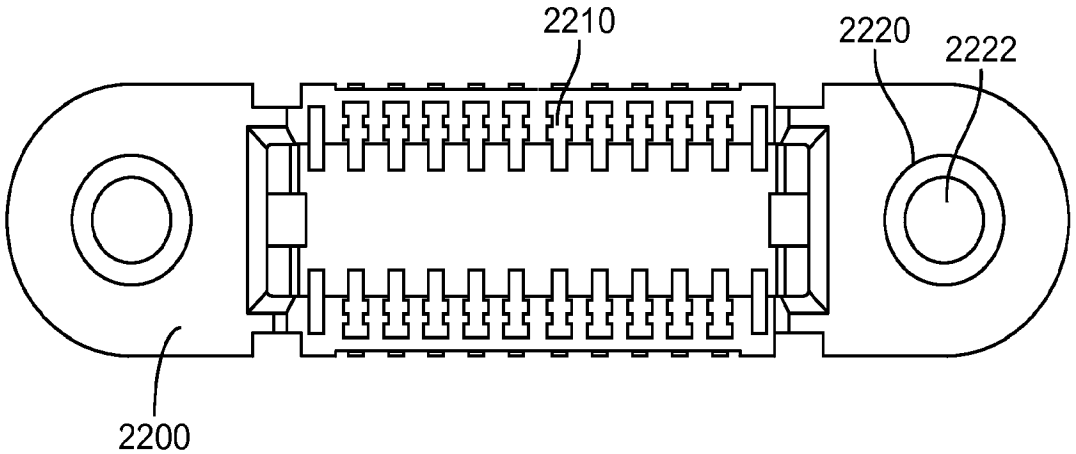
FIG. 13 illustrates a top view of a receptacle mounted on printed circuit board.

FIG. 13 illustrates a top view of receptacle 2200 mounted on printed circuit board. Receptacle 2200 may include contacts 2210 and bosses 2220. Bosses 2220 may each include opening 2222 for accepting an end of a fastener.

Figure 14:
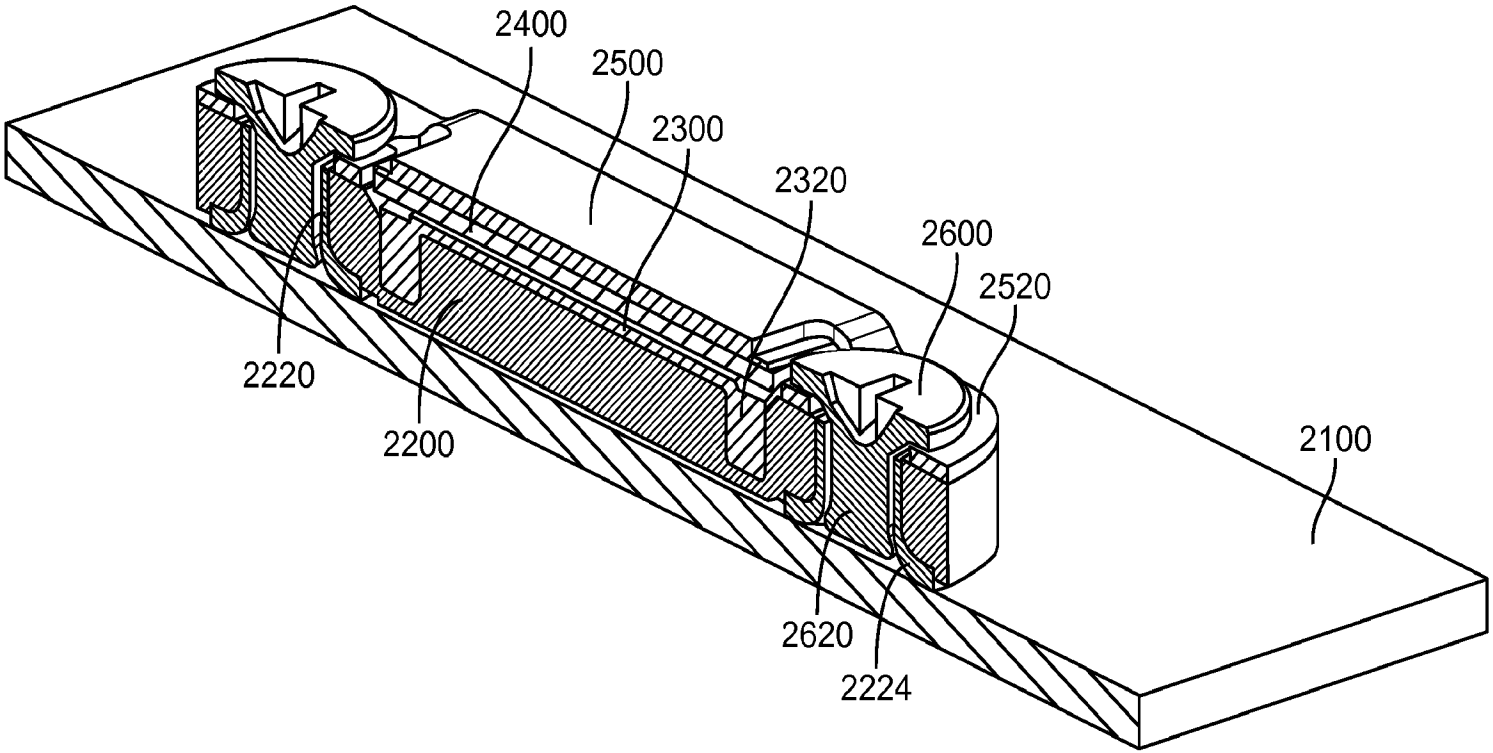
FIG. 14 illustrates a cutaway perspective view of a portion of an electronic system according to an embodiment of the present invention.

FIG. 14 illustrates a cutaway perspective view of a portion of an electronic system according to an embodiment of the present invention. Receptacle 2200 may be mounted on printed circuit board 2100. Receptacle 2200 may include contacts having contact portions. The contact portions may connect to traces or planes on or in printed circuit board 2100. Insert 2300 may be mated with receptacle 2200. Specifically, tabs 2320 on insert 2300 may fit in corresponding recesses in receptacle 2200. Insert 1300 may include contacts having contact portions. The contact portions may form electrical connections with traces or planes on our and flexible circuit board 2400. Cowling 2500 may be placed over flexible circuit board 2400 to act as a stiffener. Portions 2620 of fasteners 2600 may be inserted into bosses 2220. Bosses 2220 may have outwardly flared or flange portions 2224. Portions 2224 may be soldered to contact or solderable areas on printed circuit board 2100.

Figure 15:
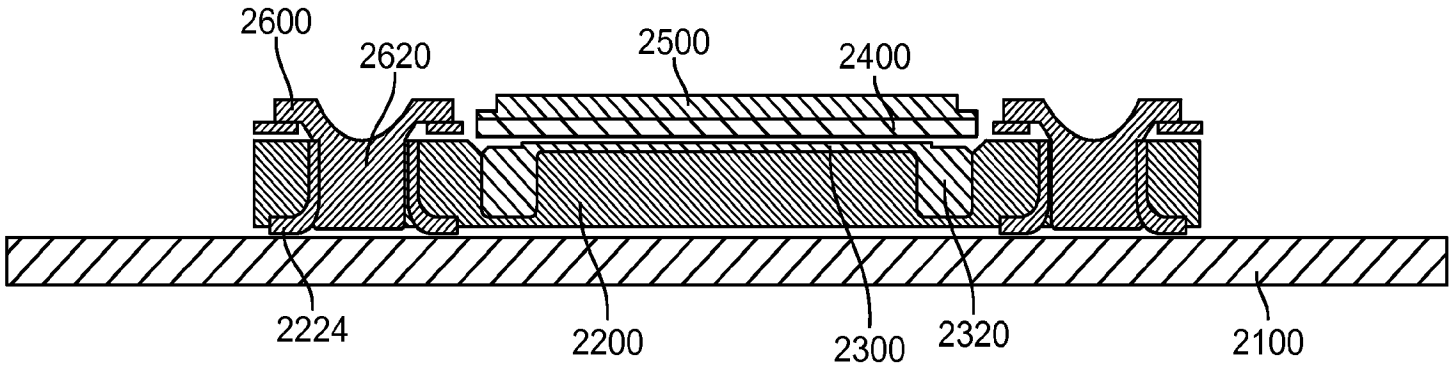
FIG. 15 illustrates a cutaway side view of a portion of an electronic system according to an embodiment of the present invention.

FIG. 15 illustrates a cutaway side view of a portion of an electronic system according to an embodiment of the present invention. Again, receptacle 2200 may be mounted on printed circuit board 2100. Receptacle 2200 may include contacts having contact portions. The contact portions may connect to traces or planes on or in printed circuit board 2100. Insert 2300 may be mated with receptacle 2200. Specifically, tabs 2320 on insert 2300 may fit in corresponding recesses in receptacle 2200. Insert 2300 may include contacts having contact portions. The contact portions may form electrical connections with traces or planes on our and flexible circuit board 2400. Cowling 2500 may be placed over flexible circuit board 2400 to act as a stiffener. Portions 2620 of fasteners 2600 may be inserted into bosses 2220. Bosses 2220 may have outwardly flared or flange portions 2224. Portions 2224 may be soldered to contact or solderable areas on printed circuit board 2100.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A board-to-board connector system comprising:

a receptacle having a bottom surface, the receptacle including a first plurality of contacts, each contact having a contacting portion approximately on the bottom surface, and a first boss having a surface-mount portion approximately on the bottom surface;

an insert to mechanically mate with the receptacle, the insert including a second plurality of contacts to form electrical paths with the first plurality of contacts; and a first fastener to fit through a first opening in the insert and into the first boss to secure the insert to the receptacle, wherein the receptacle is injection molded around the first boss.

2. The board-to-board connector system of claim 1 wherein the first fastener is a screw.

3. The board-to-board connector system of claim 1 wherein the contacting portions of the first plurality of contacts are surface-mount contact portions.

4. The board-to-board connector system of claim 1 wherein the first and second plurality of contacts each comprise at least one ground contact and at least one power contact.

5. The board-to-board connector system of claim 1 wherein the first fastener is held in place using an adhesive.

6. The board-to-board connector system of claim 1 further comprising a second boss, the second boss having a surface-mount portion approximately on the bottom surface of the receptacle.

7. A board-to-board connector system comprising:

a receptacle having a bottom surface, the receptacle including a first plurality of contacts, each contact having a contacting portion approximately on the bottom surface, and a first boss having a surface-mount portion approximately on the bottom surface;

an insert to mechanically mate with the receptacle, the insert including a second plurality of contacts to form electrical paths with the first plurality of contacts; and a first fastener to fit through a first opening in the insert and into the first boss to secure the insert to the receptacle, wherein the first boss is press-fit into the receptacle.

8. The board-to-board connector system of claim 7 wherein the contacting portions of the first plurality of contacts are surface-mount contact portions.

9. The board-to-board connector system of claim 7 wherein the first and second plurality of contacts each comprise at least one ground contact and at least one power contact.

10. The board-to-board connector system of claim 7 wherein the first fastener is a screw.

11. The board-to-board connector system of claim 7 wherein the first fastener is held in place using an adhesive.

12. The board-to-board connector system of claim 7 further comprising a second boss, the second boss having a surface-mount portion approximately on the bottom surface of the receptacle.

13. A board-to-board connector system comprising:

a receptacle having a bottom surface, the receptacle including a first plurality of contacts, each contact having a contacting portion approximately on the bottom surface, and a first boss having a surface-mount portion approximately on the bottom surface;

an insert to mechanically mate with the receptacle, the insert including a second plurality of contacts to form electrical paths with the first plurality of contacts; and a first fastener to fit through a first opening in the insert and into the first boss to secure the insert to the receptacle, wherein the first fastener is held in place using an adhesive.

14. A board-to-board connector system comprising:

a receptacle having a bottom surface, the receptacle including a first plurality of contacts, each contact having a contacting portion approximately on the bottom surface, and a first boss having a surface-mount portion approximately on the bottom surface;

an insert to mechanically mate with the receptacle, the insert including a second plurality of contacts to form electrical paths with the first plurality of contacts;

a first fastener to fit through a first opening in the insert and into the first boss to secure the insert to the receptacle; and a cowling over the insert.

15. The board-to-board connector system of claim 14 wherein the cowling acts as a stiffener for a flexible circuit board, the flexible circuit board between the cowling and the insert.

16. The board-to-board connector system of claim 14 wherein the first boss is approximately located in a center of the receptacle.

17. The board-to-board connector system of claim 14 further comprising a second boss, the second boss having a surface-mount portion approximately on the bottom surface of the receptacle.

18. The board-to-board connector system of claim 17 wherein the first boss and the second boss are located near opposite ends of the receptacle.

19. The board-to-board connector system of claim 17 wherein the receptacle is injection molded around the first boss and the second boss.

20. The board-to-board connector system of claim 17 wherein the first boss and the second boss are press-fit into the receptacle.

21. An electronic device comprising:

a first circuit board;

a receptacle comprising a first plurality of contacts, each having a contacting portion contacting the first circuit board, the receptacle further comprising a boss having a surface mount portion contacting the first circuit board;

an insert mated to the receptacle, the insert comprising a second plurality of contacts to form electrical paths with the first plurality of contacts, each of the second plurality of contacts having a contacting portion contacting a second circuit board;

a cowling having an opening; and a fastener fit through the opening in the cowling and into the boss to secure the insert to the receptacle, wherein the boss is in electrical contact with a ground connection on the first circuit board.

22. The electronic device of claim 21 wherein the first circuit board is a printed circuit board.

23. The electronic device of claim 21 wherein the first circuit board is a flexible circuit board.

* * * * *